US009613500B2

(12) United States Patent
Hornik et al.

(10) Patent No.: US 9,613,500 B2
(45) Date of Patent: Apr. 4, 2017

(54) GAME SYSTEM AND METHOD WITH ADJUSTABLE ELIGIBILITY FOR BONUS FEATURES

(75) Inventors: Jeremy M. Hornik, Chicago, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 919 days.

(21) Appl. No.: 13/290,683

(22) Filed: Nov. 7, 2011

(65) Prior Publication Data

US 2012/0115594 A1 May 10, 2012

Related U.S. Application Data

(60) Provisional application No. 61/413,307, filed on Nov. 12, 2010, provisional application No. 61/410,824, filed on Nov. 5, 2010, provisional application No. 61/410,850, filed on Nov. 5, 2010.

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3258* (2013.01)

(58) Field of Classification Search

CPC ..... G07F 17/32
USPC ..... 463/27
See application file for complete search history.

(56) References Cited

U.S. PATENT DOCUMENTS

| | | | | |
|---|---|---|---|---|
| 4,752,068 | A | 6/1988 | Endo | 273/1 |
| 5,575,474 | A | 11/1996 | Rossides | 463/26 |
| 5,609,525 | A | 3/1997 | Ohno et al. | 463/43 |
| 5,833,537 | A | 11/1998 | Barrie | 463/21 |
| 5,957,775 | A | 9/1999 | Cherry | 463/16 |
| 6,004,211 | A | 12/1999 | Brenner et al. | 463/40 |
| 6,012,045 | A | 1/2000 | Barzilai et al. | 705/37 |
| 6,012,983 | A | 1/2000 | Walker et al. | 463/20 |
| 6,015,344 | A | 1/2000 | Kelly et al. | 463/16 |
| 6,068,553 | A | 5/2000 | Parker | 463/27 |
| 6,077,163 | A | 6/2000 | Walker et al. | 463/26 |
| 6,113,098 | A | 9/2000 | Adams | 273/143 R |
| 6,165,071 | A | 12/2000 | Weiss | 463/24 |
| 6,234,896 | B1 | 5/2001 | Walker et al. | 463/16 |
| 6,254,481 | B1 | 7/2001 | Jaffe | 463/20 |
| 6,273,820 | B1 | 8/2001 | Haste, III | 463/40 |
| 6,280,328 | B1 | 8/2001 | Holch et al. | 463/42 |
| 6,287,194 | B1 | 9/2001 | Okada et al. | 463/16 |
| 6,302,790 | B1 | 10/2001 | Brossard | 463/20 |

(Continued)

FOREIGN PATENT DOCUMENTS

| | | | |
|---|---|---|---|
| WO | WO 99/29381 | 6/1999 | A63F 7/00 |
| WO | WO 2005/082480 | 9/2005 | A63F 13/00 |

(Continued)

*Primary Examiner* — Lawrence Galka
(74) *Attorney, Agent, or Firm* — Nixon Peabody LLP

(57) ABSTRACT

A method and a gaming system for adjusting eligibility rules for wager-dependent bonus features in a wagering game, the game including one or more rule-adjusting activities related to randomly generated outcomes of the game. Rule-adjusting activities achieved by a player can be assessed according a qualification scheme, and can qualify the player for the wager-dependent bonus award even though the player made a non-eligible wager.

18 Claims, 8 Drawing Sheets

(56) References Cited

U.S. PATENT DOCUMENTS

| | | | | |
|---|---|---|---|---|
| 6,311,976 | B1 | 11/2001 | Yoseloff et al. | 273/138 |
| 6,319,127 | B1 | 11/2001 | Walker et al. | 463/26 |
| 6,364,765 | B1 | 4/2002 | Walker et al. | 463/16 |
| 6,364,766 | B1 | 4/2002 | Anderson et al. | 463/16 |
| 6,365,765 | B1 | 4/2002 | Baldwin et al. | 556/440 |
| 6,431,983 | B2 | 8/2002 | Acres | 463/25 |
| 6,506,117 | B2 | 1/2003 | DeMar | 463/20 |
| 6,506,118 | B1 | 1/2003 | Baerlocher et al. | 463/25 |
| 6,517,433 | B2 | 2/2003 | Loose et al. | 463/20 |
| 6,604,740 | B1 | 8/2003 | Singer et al. | 273/292 |
| 6,663,489 | B2 | 12/2003 | Baerlocher | 463/20 |
| 6,722,981 | B2 | 4/2004 | Kaminkow et al. | 463/25 |
| 6,722,985 | B2 | 4/2004 | Criss-Puszkiewicz et al. | |
| 6,745,236 | B1 | 6/2004 | Hawkins et al. | 709/203 |
| 6,758,757 | B2 | 7/2004 | Luciano, Jr. et al. | 463/43 |
| 6,776,713 | B2 | 8/2004 | Gauselmann | 463/16 |
| 6,780,111 | B2 | 8/2004 | Cannon et al. | 463/25 |
| 6,800,027 | B2 | 10/2004 | Giobbi et al. | 463/24 |
| 6,811,486 | B1 | 11/2004 | Luciano, Jr. | 463/24 |
| 6,869,362 | B2 | 3/2005 | Walker et al. | 463/25 |
| 6,923,721 | B2 | 8/2005 | Luciano et al. | 463/24 |
| 6,960,136 | B2 | 11/2005 | Joshi et al. | 463/25 |
| 7,182,690 | B2 | 2/2007 | Giobbi et al. | 463/24 |
| 7,291,068 | B2 | 11/2007 | Bryant et al. | 463/25 |
| 7,303,475 | B2 | 12/2007 | Britt et al. | 463/42 |
| 2001/0024971 | A1 | 9/2001 | Brossard | 463/30 |
| 2001/0046893 | A1 | 11/2001 | Giobbi et al. | 463/24 |
| 2002/0016202 | A1 | 2/2002 | Fertitta, III et al. | 463/25 |
| 2002/0028708 | A1 | 3/2002 | Busch et al. | 463/42 |
| 2002/0039919 | A1 | 4/2002 | Joshi et al. | 463/20 |
| 2002/0065716 | A1 | 5/2002 | Kuschill | 705/14 |
| 2002/0077173 | A1 | 6/2002 | Luciano, Jr. et al. | 463/23 |
| 2002/0077174 | A1 | 6/2002 | Luciano et al. | 463/25 |
| 2002/0093136 | A1 | 7/2002 | Moody | 273/139 |
| 2002/0094871 | A1 | 7/2002 | Luciano, Jr. et al. | 463/43 |
| 2002/0107065 | A1 | 8/2002 | Rowe | 463/157 |
| 2002/0151349 | A1 | 10/2002 | Joshi | 463/20 |
| 2002/0196342 | A1 | 12/2002 | Walker et al. | 348/157 |
| 2003/0013515 | A1 | 1/2003 | Rowe et al. | 463/25 |
| 2003/0013531 | A1 | 1/2003 | Rowe et al. | 463/42 |
| 2003/0036422 | A1 | 2/2003 | Baerlocher et al. | 463/20 |
| 2003/0036427 | A1 | 2/2003 | Brandstetter et al. | 463/29 |
| 2003/0045354 | A1 | 3/2003 | Giobbi | 463/40 |
| 2003/0064794 | A1 | 4/2003 | Mead et al. | 463/25 |
| 2003/0078101 | A1 | 4/2003 | Schneider et al. | 463/42 |
| 2003/0083943 | A1 | 5/2003 | Adams et al. | 705/14 |
| 2003/0100362 | A1 | 5/2003 | Horniak et al. | 463/25 |
| 2003/0106769 | A1 | 6/2003 | Weiss | 194/201 |
| 2003/0114219 | A1 | 6/2003 | McClintic | 463/25 |
| 2003/0114220 | A1 | 6/2003 | McClintic | 463/25 |
| 2003/0119579 | A1 | 6/2003 | Walker et al. | 463/20 |
| 2003/0146574 | A1 | 8/2003 | Duhamel | 273/292 |
| 2003/0153379 | A1 | 8/2003 | Beaulieu | 463/16 |
| 2003/0157979 | A1 | 8/2003 | Cannon et al. | 463/16 |
| 2003/0195024 | A1 | 10/2003 | Slattery | 463/9 |
| 2003/0211881 | A1 | 11/2003 | Walker et al. | 463/20 |
| 2004/0048657 | A1 | 3/2004 | Gauselmann | 463/25 |
| 2004/0053680 | A1 | 3/2004 | Schultz | 463/20 |
| 2004/0142742 | A1 | 7/2004 | Schneider et al. | 463/25 |
| 2004/0209662 | A1 | 10/2004 | Wadleigh | 463/16 |
| 2004/0229700 | A1 | 11/2004 | Cannon et al. | 463/42 |
| 2005/0003886 | A1 | 1/2005 | Englman et al. | 463/25 |
| 2005/0159207 | A1 | 7/2005 | Thomas | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/25 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2007/0021183 | A1 | 1/2007 | Fiden et al. | 463/17 |
| 2007/0218982 | A1* | 9/2007 | Baerlocher | 463/27 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0039191 | A1* | 2/2008 | Cuddy | 463/25 |
| 2008/0113770 | A1 | 5/2008 | Gelber et al. | 463/25 |
| 2008/0235323 | A1 | 9/2008 | Block | 709/201 |
| 2008/0274814 | A1 | 11/2008 | Gagner et al. | 463/43 |
| 2008/0293473 | A1 | 11/2008 | Fiden et al. | 463/16 |
| 2008/0293478 | A1 | 11/2008 | Anderson et al. | 463/25 |
| 2008/0300046 | A1 | 12/2008 | Gagner et al. | 463/25 |
| 2008/0300049 | A1 | 12/2008 | Anderson et al. | 463/25 |
| 2009/0036196 | A1 | 2/2009 | Ansari et al. | 463/20 |
| 2009/0054136 | A1 | 2/2009 | Gagner et al. | 463/25 |
| 2009/0156299 | A1 | 6/2009 | Anderson et al. | 463/25 |
| 2009/0170593 | A1 | 7/2009 | Pacey | 463/25 |
| 2009/0170596 | A1 | 7/2009 | Gagner et al. | 463/25 |
| 2009/0197684 | A1* | 8/2009 | Arezina et al. | 463/42 |
| 2009/0291731 | A1 | 11/2009 | Jaffe et al. | 463/16 |
| 2009/0298577 | A1 | 12/2009 | Gagner et al. | 463/25 |
| 2010/0009742 | A1* | 1/2010 | Popovich et al. | 463/25 |
| 2010/0099486 | A1* | 4/2010 | Koerner et al. | G07F 17/32 463/25 |

FOREIGN PATENT DOCUMENTS

| | | | |
|---|---|---|---|
| WO | WO 2006/002241 | 1/2006 | A63F 13/00 |
| WO | WO 2006/004831 | 1/2006 | A63F 13/00 |
| WO | WO 2006/004832 | 1/2006 | A63F 13/00 |
| WO | WO 2006/005073 | 1/2006 | A63F 9/24 |
| WO | WO 2006/017036 | 2/2006 | A63F 13/00 |
| WO | WO 2006/017067 | 2/2006 | A63F 13/00 |
| WO | WO 2006/017068 | 2/2006 | A63F 13/00 |
| WO | WO 2006/020811 | 2/2006 | A63F 9/24 |
| WO | WO 2006/026250 | 3/2006 | A63F 13/00 |
| WO | WO 2006/044252 | 4/2006 | A63F 9/24 |
| WO | WO 2006/119070 | 11/2006 | G06F 9/44 |
| WO | WO 2006/128019 | 11/2006 | H01Q 1/00 |
| WO | WO 2007/011636 | 1/2007 | G06F 19/00 |
| WO | WO 2007/013970 | 2/2007 | A63F 13/00 |
| WO | WO 2007/022256 | 2/2007 | A63F 9/24 |
| WO | WO 2007/032916 | 3/2007 | A63F 13/00 |
| WO | WO 2007/089410 | 8/2007 | A63F 9/24 |
| WO | WO 2007/098017 | 8/2007 | G06F 19/00 |
| WO | WO 2007/098225 | 8/2007 | G06F 19/00 |
| WO | WO 2007/103054 | 9/2007 | G06F 19/00 |
| WO | WO 2007/130464 | 11/2007 | A63F 13/06 |
| WO | WO 2007/146177 | 12/2007 | A63F 13/04 |
| WO | WO 2008/005298 | 1/2008 | G06F 19/00 |
| WO | WO 2008/008325 | 1/2008 | G06F 19/00 |
| WO | WO 2008/024349 | 2/2008 | G06F 19/00 |
| WO | WO 2008/030271 | 3/2008 | A63F 13/04 |
| WO | WO 2008/048634 | 4/2008 | A63F 13/06 |
| WO | WO 2008/057191 | 5/2008 | G07F 17/32 |
| WO | WO 2008/057323 | 5/2008 | A63F 13/00 |
| WO | WO 2008/060517 | 5/2008 | A63F 13/10 |
| WO | WO 2008/063349 | 5/2008 | A63F 13/10 |
| WO | WO 2008/063393 | 5/2008 | A63F 9/24 |
| WO | WO 2008/097470 | 8/2008 | G07F 17/32 |
| WO | WO 2008/118318 | 10/2008 | A63F 13/00 |
| WO | WO 2008/121363 | 10/2008 | A63F 9/24 |
| WO | WO 2008/133850 | 11/2008 | G07F 17/32 |
| WO | WO 2008/143843 | 11/2008 | G07F 17/32 |
| WO | WO 2008/143845 | 11/2008 | G07F 17/32 |
| WO | WO 2008/156596 | 12/2008 | G07F 17/32 |
| WO | WO 2009/005578 | 1/2009 | A63F 13/06 |
| WO | WO 2009/006083 | 1/2009 | H04L 9/00 |
| WO | WO 2009/011832 | 1/2009 | A63F 13/06 |
| WO | WO 2009/017591 | 2/2009 | A63F 13/06 |
| WO | WO 2009/029271 | 3/2009 | A63F 13/00 |
| WO | WO 2009/038638 | 3/2009 | A63F 13/00 |
| WO | WO 2009/051637 | 4/2009 | A63F 9/24 |
| WO | WO 2009/058240 | 5/2009 | A63F 9/24 |
| WO | WO 2009/061365 | 5/2009 | A63F 9/24 |
| WO | WO 2009/061457 | 5/2009 | G07F 17/32 |
| WO | WO 2009/061476 | 5/2009 | A63F 9/24 |
| WO | WO 2009/061479 | 5/2009 | A63F 9/24 |
| WO | WO 2009/061634 | 5/2009 | A63F 9/24 |
| WO | WO 2009/061696 | 5/2009 | A63F 9/24 |
| WO | WO 2009/062201 | 5/2009 | A63F 13/00 |
| WO | WO 2009/091676 | 7/2009 | A63F 9/24 |
| WO | WO 2009/097538 | 8/2009 | A63F 9/24 |

(56) References Cited

FOREIGN PATENT DOCUMENTS

| | | | |
|---|---|---|---|
| WO | WO 2009/123972 | 10/2009 | ..... A63F 13/10 |
| WO | WO 2010/096784 | 8/2010 | ..... A63F 13/00 |
| WO | WO 2010/151547 | 12/2010 | ..... A63F 9/24 |

* cited by examiner

GAME SYSTEM AND METHOD WITH ADJUSTABLE ELIGIBILITY FOR BONUS FEATURES

CLAIM OF PRIORITY

This application is related to and claims the benefits of priority from U.S. Provisional Application No. 61/410,824 filed Nov. 5, 2010, U.S. Provisional Application No. 61/410,850, filed Nov. 5, 2010, and U.S. Provisional Application No. 61/413,307, filed Nov. 12, 2010, all of which are hereby incorporated by reference herein in their entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to wagering games where the amount wagered affects eligibility for bonus features and bonus awards occurring during the wagering game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One way to increase player participation and enthusiasm for a game or a family of games is by adding a "bonus feature" or "bonus game" that may be played in conjunction with a "basic" game. The bonus feature may comprise any type of game, either similar to or completely different from the basic game, which is entered upon the occurrence of a selected event or outcome in the basic game. Generally, bonus features provide a greater expectation of winning than the basic game and may also be accompanied with more attractive or unusual video displays and/or audio. Because the bonus feature concept offers tremendous advantages in player appeal and excitement relative to other known games, and because such games and features are attractive to both players and operators, there is a continuing need to develop gaming machines with new types of bonus games and features to satisfy the demands of players and operators.

Bonus games and features may additionally award players with "progressive jackpot" awards that are funded, at least in part, by a percentage of coin-in from the gaming machine or a plurality of participating gaming machines. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning outcome" is achieved at a participating gaming device. If the gaming device is a slot machine, a progressive winning outcome may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement. Typically, once the progressive jackpot is awarded, the jackpot amount is reset to the predetermined minimum amount.

In progressive games, there may be a single progressive jackpot or multiple progressive jackpots that may be awarded. Each progressive jackpot is typically awarded upon the occurrence of a single, qualifying jackpot-won event (e.g., a predetermined symbol combination on an active payline of the base game). In addition, the probability of achieving the qualifying jackpot-won event and, thus, winning a particular progressive jackpot is typically fixed prior to initiation of the wagering game, and remains fixed throughout game play.

SUMMARY OF THE INVENTION

According to one embodiment of the present invention, a method of adjusting eligibility rules for progressive jackpot awards in a wagering game, that includes one or more rule-adjusting activities related to prior game play, comprises receiving a wager from a player, via an input device, to play the wagering game, the wagering game including at least one progressive-triggering event, the wager being either an initially eligible amount or an initially non-eligible amount, and evaluating, via the one or more processors, any rule-adjusting activities achieved by the player to determine if one or more of the achieved rule-adjusting activities qualify the player for enhanced eligibility according to a predetermined qualification scheme. The method further comprises, in response to a progressive-triggering event following an initially eligible wager amount, randomly generating an outcome, via one or more processors, to determine awarding one of a first progressive award and a second progressive award. Also, in response to a progressive-triggering event following an initially non-eligible wager amount, randomly generating an outcome to determine awarding one of the first progressive award and the second progressive award if the player is qualified for enhanced eligibility, wherein the probability of winning the first progressive award increases with the amount wagered, randomly generating an outcome to determine awarding one of the second progressive award and neither of the first or second progressive awards if the player is not qualified for enhanced eligibility, wherein the probability of winning the second progressive award increases with the amount wagered, displaying the outcome to the player on one or more displays; and awarding the player the determined award, if any.

According to another embodiment of the invention, a method of adjusting eligibility rules for wager-dependent bonus features in a wagering game, the wagering game including one or more rule-adjusting activities related to prior game play, comprises receiving a wager from a player, via an input device, to initiate a randomly generated game outcome of a plurality of game outcomes for the wagering game, the randomly generated game outcome being displayed to the player on one or more displays, wherein the wagering game includes at least one bonus-triggering event. The method further comprises determining, via one or more processors, whether the received wager is an initially eligible wager amount or an initially non-eligible wager amount, and evaluating, via the one or more processors, any rule-adjusting activities achieved by the player to determine if one or more of the achieved rule-adjusting activities is sufficient to treat an initially non-eligible wager amount as a qualified wager. The method further comprises, in response to the bonus-triggering event occurring and the determination that the initially eligible wager amount was received, awarding the player a first bonus award, and, in response to the bonus-triggering event occurring and the determination that the initially non-eligible wager amount was received, awarding the player a second bonus award if the received non-eligible wager amount can be treated as a qualified wager.

According to yet another embodiment of the invention, a gaming system for conducting a wagering game including adjustable eligibility rules for wager-dependent bonus features comprises an input device for receiving a wager from a player to initiate the wagering game, the wagering game including at least one bonus-triggering event. The system further comprises one or more displays for displaying game information and a controller being in communication with the wager input device and the one or more displays, the controller including one or more processors and being operable to detect a wager received via the input device, evaluate, via the one or more processors, any rule adjusting activities achieved by the player to determine if one or more of the achieved rule-adjusting activities qualify the player for enhanced eligibility according to a predetermined qualification scheme, and, in response to a bonus-triggering event following an initially non-eligible wager amount, randomly generate an outcome to determine awarding the player a bonus award if the player is qualified for enhanced eligibility, and award the player the bonus award.

In yet another embodiment of the invention, a gaming system for conducting a wagering game including adjustable eligibility rules for wager-dependent bonus features comprises an input device for receiving a wager from a player to initiate the wagering game, the wagering game including at least one bonus-triggering event, the wager being either an initially eligible amount or an initially non-eligible amount. The system further comprises one or more displays for displaying game information, a system memory including one or more memory storage units, a controller comprising one or more processors, the controller being in communication with the wager input device, the one or more displays, and the system memory, the controller being operable to detect a wager received, via the wager input device, to initiate the wagering game, the wagering game including a basic game and one or more bonus features, and store, in system memory, any rule-adjusting activities related to prior game play in the basic game and in the one or more bonus features, the rule-adjusting activities being achieved by the player during the prior game play. The controller is further operative to evaluate, via the one or more processors, any rule-adjusting activities achieved by the player that are stored in the system memory, to determine if one or more of the achieved rule-adjusting activities qualify the player for enhanced eligibility according to a predetermined qualification scheme and, in response to a bonus-triggering event following an initially eligible wager amount, randomly generate a bonus outcome to determine a bonus award, display the bonus outcome on at least one of the displays, and award the bonus award to the player. The controller is still further operative to, in response to a bonus-triggering event following an initially non-eligible wager amount, a) if the player is qualified for enhanced eligibility, randomly generate a bonus outcome to determine the bonus award, display the bonus outcome on at least one of the displays, and award the bonus award to the player, and b) if the player is not qualified for enhanced eligibility, conclude the wagering game.

Additional embodiments of the invention will be apparent to those of ordinary skill in the art in view of the detailed description of various embodiments, which is made with reference to the drawings, a brief description of which is provided below.

BRIEF DESCRIPTION OF THE DRAWINGS

The drawings described below have been timely submitted with this specification and are incorporated herein by reference in their entirety.

Figure 1:
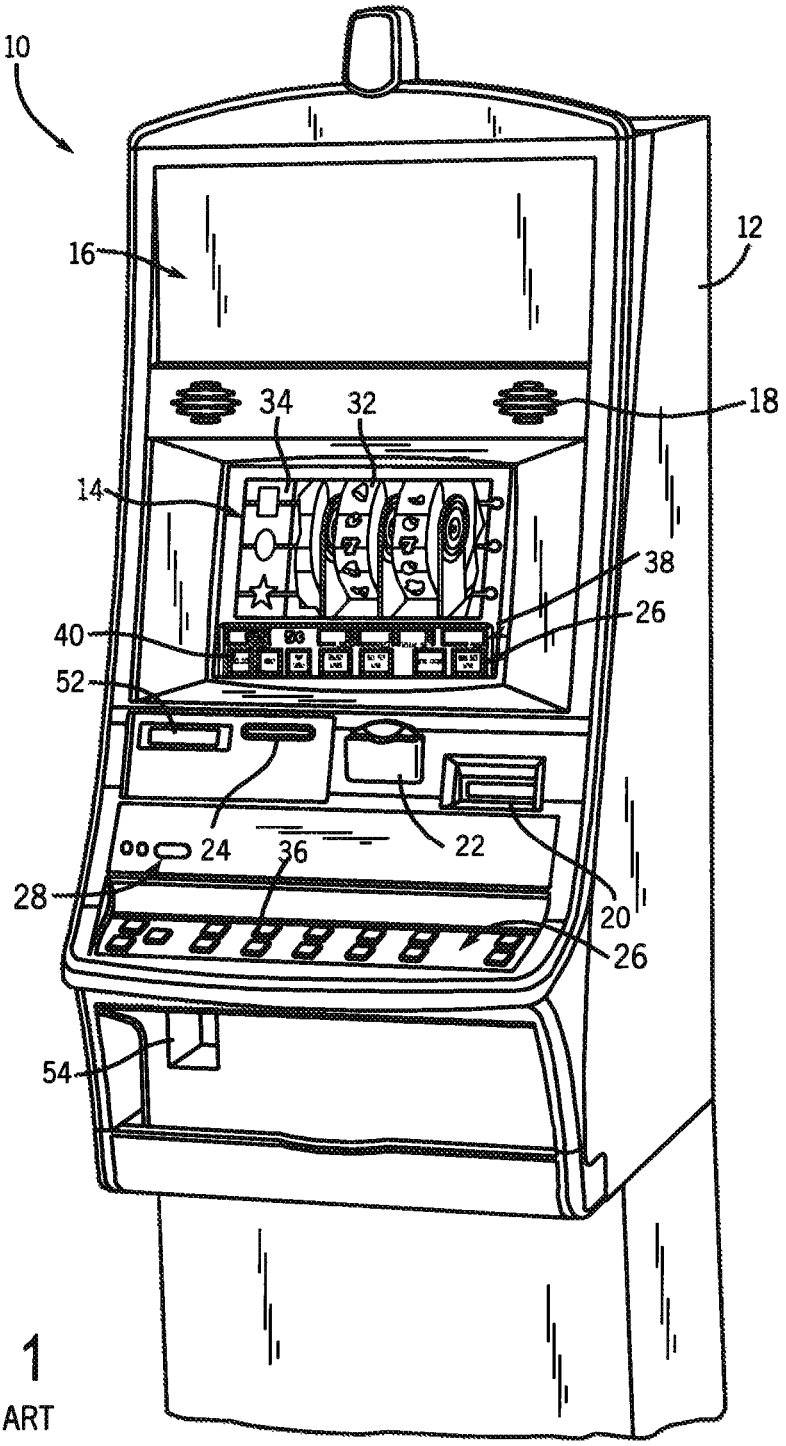
FIG. 1 PRIOR ART
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings, and will herein be described in detail, various embodiments of the invention. It is understood that the present disclosure is to be considered as an exemplification of the principles of the invention and is not intended to limit the broad aspect of the invention to the embodiments illustrated herein.

Referring to FIG. 1, there is shown a gaming terminal 10 similar to those used in gaming establishments, such as casinos. The gaming terminal 10 may be any type of gaming terminal and may have varying structures and methods of operation. For example, in some embodiments, the gaming terminal 10 can be an electromechanical gaming terminal configured to play mechanical slots, whereas in other embodiments, the gaming terminal can be an electronic gaming terminal configured to play a video casino game, such as slots, keno, poker, blackjack, roulette, craps, etc. Although the gaming terminal 10 is shown as a free-standing, upright-style terminal, the gaming terminal can be implemented in a wide variety of other forms, such as a free-standing, slant-top terminal, a portable or handheld device primarily used for gaming, such as is disclosed by way of example in PCT Patent Application No. PCT/US2007/000792 filed Jan. 26, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, and etcetera.

The gaming terminal 10 illustrated in FIG. 1 comprises a cabinet or housing 12. For output devices, the gaming terminal 10 can include a primary display area 14, a secondary display area 16, and one or more audio speakers 18. The primary display area 14 and/or secondary display area 16 can display information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 can include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that various other peripheral devices and other elements are readily utilizable, singly and in combination, to create various forms of a gaming terminal in accord with embodiments of the present invention.

The primary display area 14 can include a mechanical-reel display, a video display, and a combination thereof in which a transmissive video display is disposed in front of the mechanical-reel display to portray a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display can be a cathode ray tube (CRT), a high-resolution liquid crystal display (LCD), a plasma display, a light emitting diode (LED), a DLP projection display, an electroluminescent (EL) panel, and any other type of display suitable for use in the gaming terminal 10, or other form factor, such as is shown in FIG. 1. The primary display area 14 can include, in relation to many aspects of wagering games conducted on the gaming terminal 10, one or more paylines 30 (see FIG. 3) extending along a portion of the primary display area. In the gaming terminal 10, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 can be a non-transmissive display. Similarly, if the wagering game conducted via the gaming terminal 10 relies only upon the mechanical reels 32, but not the video display 34, the video display 34 depicted in FIG. 1 can be replaced with a conventional glass panel. Further, in still other embodiments, the video display 34 can be disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 can be rendered in two-dimensional (e.g., using Flash Macromedia™) or three-dimensional graphics (e.g., using Renderware™), and in various other graphics types. In various embodiments, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can be any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other embodiments, the player-input devices 26 comprise technologies that do not rely upon physical contact between the player and the gaming terminal, such as speech-recognition technology, gesture-sensing technology, eye-tracking technology, etc. The player-input or user-input device(s) 26 can accept player input(s) and can transform the player input(s) to electronic data signals indicating a player selection corresponding to an enabled feature (e.g., pressing a "Max Bet" button or soft key to indicate a player's desire to place a maximum wager to play the wagering game). The input(s), once transformed into electronic data signals, can be output to a CPU or controller 42 (see FIG. 2) for processing. The electronic data signals can be selected from a group consisting essentially of an electrical current, an electrical voltage, an electrical charge, an optical signal, an optical element, a magnetic signal, and a magnetic element.

The information reader 24 (or information reader/writer) can comprise a ticket reader, card reader, bar code scanner, wireless transceiver (e.g., RFID, Bluetooth, etc.), biometric reader, a computer-readable-storage-medium interface, and various other information acceptors. As noted, the information reader may comprise a physical and/or electronic writing element to permit writing to a ticket, a card, or computer-readable-storage-medium. The information reader 24 can permit information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354 entitled "Portable Data Unit for Communicating With Gaming Machine Over Wireless Link," which is incorporated herein by reference in its entirety. The account associated with cashless gaming is, in some embodiments of the present invention, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some embodiments, the individual carrying the portable storage medium is required to enter a secondary independent authenticator (e.g., password, PIN number, biometric, etc.) to access the account stored on the portable storage medium.

Figure 2:
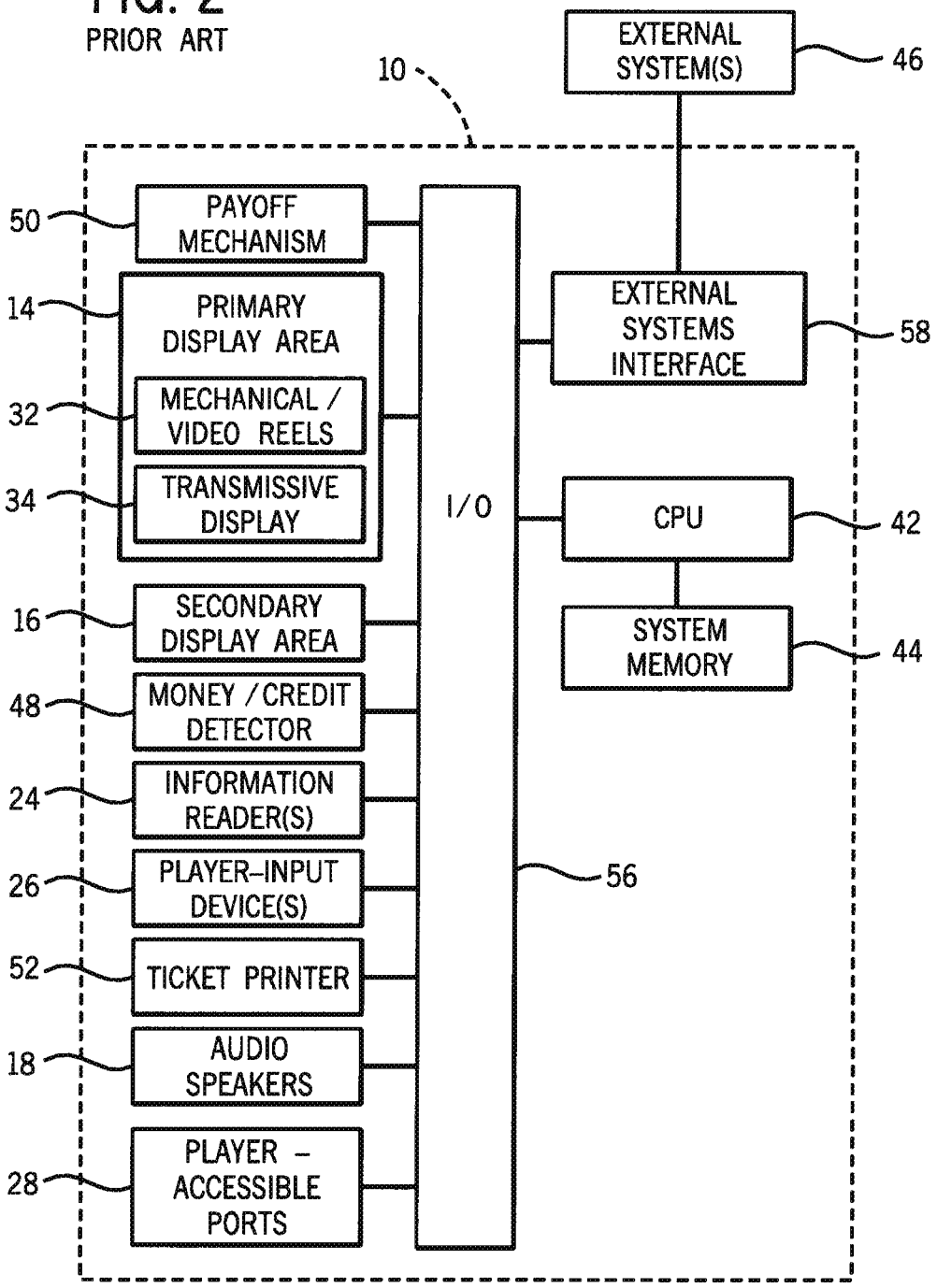
FIG. 2 PRIOR ART
FIG. 2 is a schematic view of a gaming system according to an embodiment of the present invention.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. In one embodiment, the controller 42 includes a plurality of microprocessors including a master processor, a slave processor, and a secondary or parallel processor. Controller 42 can comprise any combination of hardware, software, and/or firmware, disposed in and/or disposed outside of the gaming terminal 10, that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor can be disposed proximate a user interface device (e.g., a push button panel, a touch screen display, etc.) and a second processor can be disposed remotely from the first processor, the first and second processors being electrically connected through a network. As another example, the first processor can be disposed in a first enclosure (e.g., a gaming machine) and a second processor can be disposed in a second enclosure (e.g., a server) separate from the first enclosure, the first and second processors being communicatively connected through a network. The controller 42 can be operable to execute various gaming methods and other processes disclosed herein.

To provide gaming functions, the controller 42 can execute one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some embodiments, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common embodiments of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices can be provided, with a first storage device being disposed proximate the user interface device and a second storage device being disposed remotely from the first storage device, wherein a network is connected intermediate the first storage device and second device.

Various forms of computer-readable media may be involved in carrying one or more sequences of one or more instructions to controller 42 for execution. By way of example, the instructions can initially reside on a data storage device that is part of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some embodiments of the present invention, the controller 42 can use a local random number generator (RNG) to randomly generate a wagering game outcome from a plurality of possible outcomes. Alternatively, the outcome can be centrally determined using either an RNG or pooling scheme at a remote controller included, for example, within the external system 46.

As shown in the example of FIG. 2, the controller 42 can be coupled to the system memory 44. The system memory 44 can comprise a volatile memory (e.g., a random-access memory (RAM)) and a non-volatile memory (e.g., an EEPROM), and optionally includes multiple RAM and multiple program memories.

The controller 42 can be coupled to a money/credit detector 48 that is configured to output a signal to the controller 42 that money and/or credits have been input via one or more value-input devices, such as the bill validator 20, coin acceptor 22, a cashless gaming account, or via other sources. The value-input device(s) can be integrated with the housing 12 of the gaming terminal 10 and can be connected to the remainder of the components of the gaming terminal 10, as appropriate, via a wired connection, such as I/O 56, or wireless connection. In some embodiments, the money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 can extract the data from these signals from the money/credit detector 48, analyze the associated data, and transform the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, in some embodiments the controller 42 is also connected to, and controls, the primary display area 14, the player-input device(s) 26, and a payoff mechanism 50. Similarly, the payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or combinations thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 can be determined by one or more pay tables stored in the system memory 44.

Communications between the controller 42 and both the peripheral components of the gaming terminal 10 and the external system 46 can occur through an input/output (I/O) circuit 56, which can include any suitable bus technologies, such as an AGTL+frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

In some embodiments, the I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various embodiments, a gaming network, other gaming terminals, a gaming server, a remote controller, communications hardware, or a variety of other interfaced systems or components, in any combination. In yet other embodiments, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
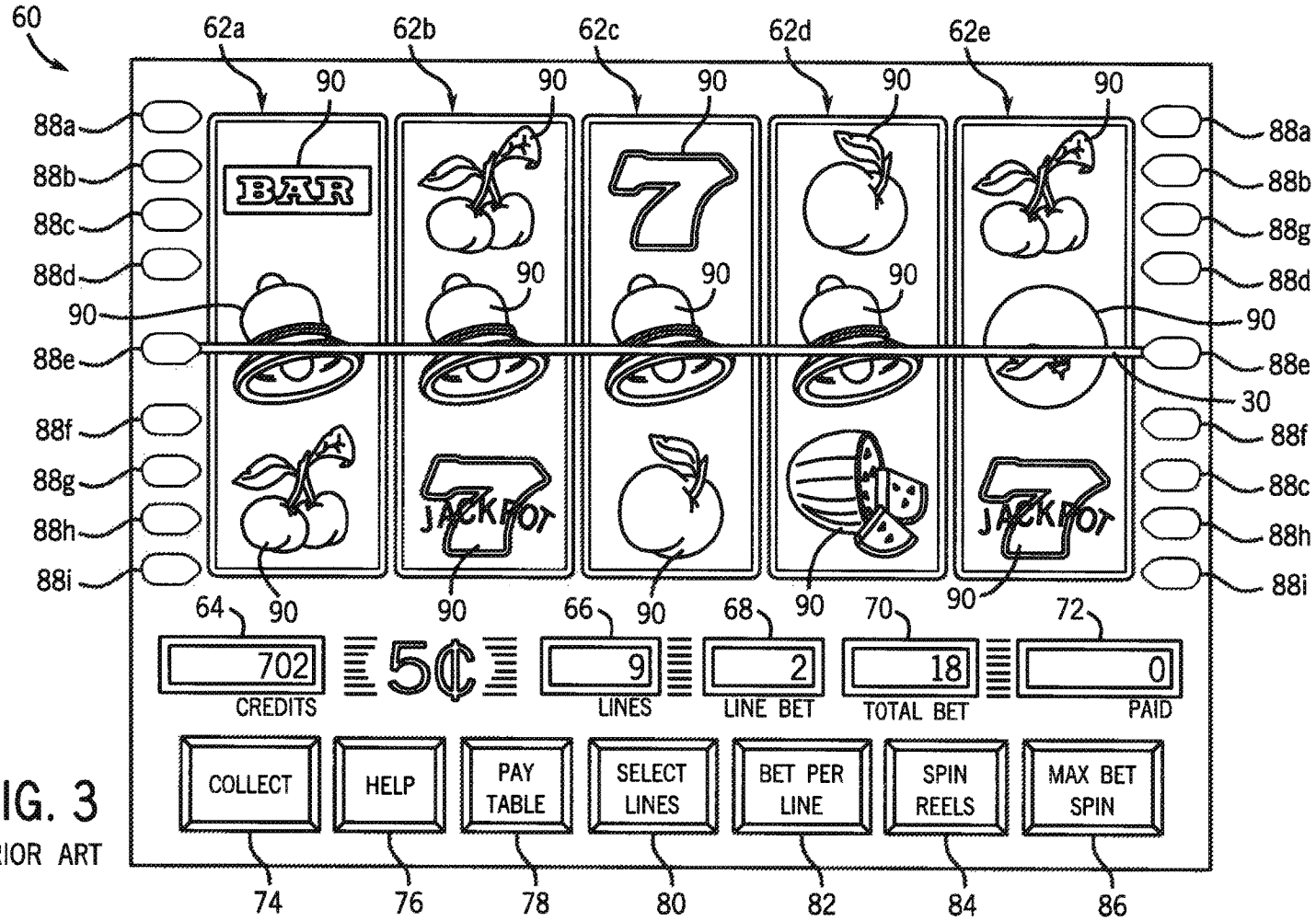
FIG. 3 PRIOR ART
FIG. 3 is an image of an exemplary basic-game screen of a wagering game displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. The player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present invention, the wagering game includes a game sequence in which a player makes a wager, such as through the money/credit detector 48, touch screen 38 soft key, button panel 26, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present invention comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some embodiments, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, some embodiments of the present invention do not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with embodiments of the present invention. Additionally, though an embodiment with five reels is shown in FIG. 3, different embodiments of the gaming terminal 10 comprise a greater or lesser number of reels in accordance with embodiments of the present invention.

Symbol combinations may be depicted as an array of rotatable reels as shown in FIG. 3, as independent reels positioned in an array, as independent reels scattered across the display and evaluated in accordance with designated positions on the display, and as various combinations and alternatives while still demonstrating the principles and inventive characteristics of the claimed invention. Further, various embodiments of the claimed invention can be configured for implementation in the various video casino games presentable via the gaming terminal 10.

In an embodiment of the claimed invention, a wagering game includes a bonus feature that can augment the basic game in order to increase player interest and enthusiasm while playing the game. A bonus feature may be a bonus game as previously described herein, and may be an aspect of a basic game and of a different bonus game. As used here and throughout, bonus feature and bonus game are considered interchangeable. The bonus feature may be a variation of the basic game and an extension of the basic game, for example free spins and extra wilds added to basic game outcomes. Alternatively, the bonus feature may be distinct and different from the basic game and may suspend the basic game for the duration of the bonus feature, returning the player to the basic game upon completion of the bonus feature. Also alternatively, the bonus feature may overlay the basic game by, for example, adding bonus awards to winning outcomes occurring during the basic game. Also alternatively, the bonus feature may be a combination of the aforementioned bonus features and may include other variations not described here.

The bonus feature is typically initiated by a bonus-triggering event occurring during game play of the basic game and, in some embodiments, during game play of the same or another bonus feature. The bonus-triggering event may be a symbol-based trigger that depends on the occurrence of a designated symbol or symbol combination during game play. The bonus-triggering event may be a randomly-generated event (mystery trigger) and the bonus-triggering event may be related in various ways to game outcomes occurring during game play.

The bonus feature may be a wager-dependent bonus feature, such that the size of the wager that initiates the wagering game affects, in some way, the implementation of the bonus feature in the current game. For example, a larger wager may increase the probability of triggering the bonus feature and may increase the probability of a winning outcome resulting from the bonus feature. Similarly, a bonus feature may be restricted to players who qualify for the bonus feature by wagering at least a designated amount and not available to players wagering less than the designated amount. In the case of a restricted bonus feature, a bonus-triggering event occurring during game-play may initiate the bonus feature if the player has qualified for the bonus feature, and may display a "not qualified" message to an unqualified player.

An example of wager-dependent bonus features may be a multi-level progressive jackpot, such as a two-level progressive jackpot. A two-level progressive jackpot having a major progressive award and a minor progressive award may require a player make a maximum wager in order to qualify for the major progressive award. When a bonus-triggering event occurs, the qualified player can play the bonus feature with the opportunity to receive the major progressive award for a winning outcome and the minor progressive award for a losing outcome. In the same game, a player who makes a less-than-maximum wager and triggers the bonus feature might receive the minor progressive award for a winning outcome, and a lesser award or no reward for a losing outcome.

Persons having ordinary skill in the art (PHOSITA) of video and mechanical slots, poker, and various wagering games will recognize a maximum wager (or Max Bet) as a wager that can secure player eligibility for top awards and bonus features. Recognizing that many players would prefer to be eligible for top awards and bonus features, but some players are unwilling or unable to consistently Max Bet, it may be desirable for a wagering game to qualify some players making non-eligible wagers to play for top awards and bonus features.

In some embodiments of the present invention, a player-qualification feature is included within a wagering game, wherein players who have achieved certain activities or met certain thresholds during game play can make lower wagers yet still have a chance to win the top awards offered to Max-Bet wagerers. As such, low-wager players experience heightened excitement in anticipation of winning larger awards, which can generate loyalty and enthusiasm for the wagering game. Furthermore, in some embodiments the specified activities, herein referred to as rule-adjusting activities, may be randomly assigned, may be player-selectable, or may be designated by other processes and combinations, so that the activities may vary from one game to the next or even during the same game. This type of variability (and selectability) can enhance the player's gaming experience by providing new and different challenges during game play.

Figure 4:
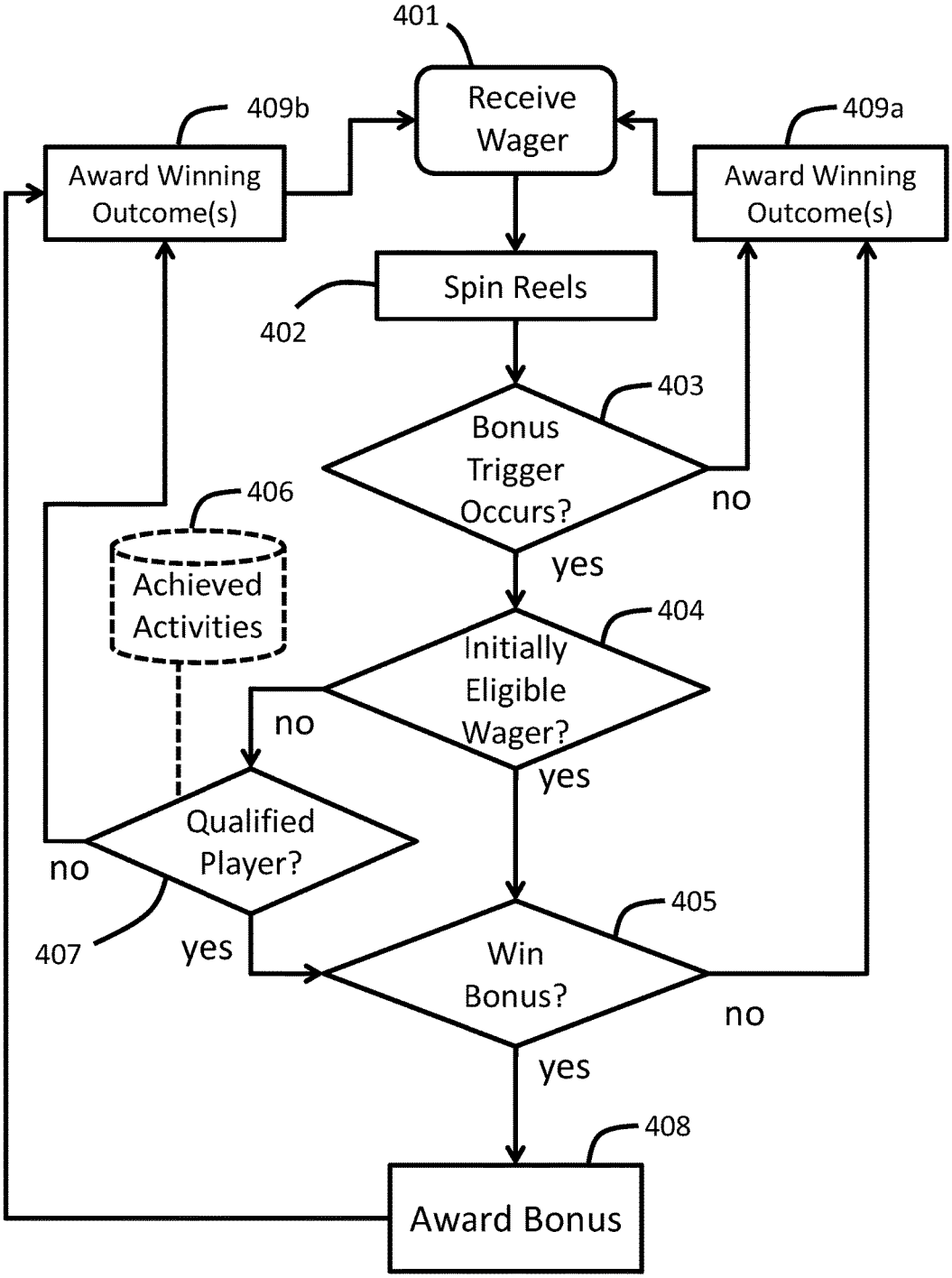
FIG. 4 is a schematic depiction of an embodiment of the claimed invention.

Referring now to FIG. 4, a schematic depiction of an embodiment of the invention shows a method of conducting a wagering game including one or more rule-adjusting activities that can qualify a player making an initially non-eligible wager to play for top awards and bonus features. The method may be conducted by the one or more processors of the gaming system of machine, such as processor 42, where at least one of the processors includes the programming for the generation of a random numbers. The exemplary method includes receiving a wager, at step 401, from a player to initiate the wagering game. The wager can be detected via one of the aforementioned wager input devices and/or player input devices, and the wager amount can be similarly specified by the player to comprise an eligible or a non-eligible wager amount.

After receiving the wager from the player, a game outcome of a plurality of game outcomes is generated. Where the wagering game is a slot game, a plurality of reels, such as reels 62*a-e*, are spun at step 402. In embodiments where the reels 62*a-e* are video reels, the resultant game outcome and the spinning reels can be displayed to the player via the primary display 14, the secondary display 16, or various other displays and combinations thereof. At least one possible outcome from the plurality of game outcomes is a bonus-triggering event.

A determination is made, at decision box 403, whether the randomly generated game outcome is a bonus-triggering event. If a bonus-triggering event has not occurred, the generated game outcome is evaluated and any winning outcomes are awarded to the player at step 409*a*. Thereafter, this wagering game instance is concluded and a subsequent wager must be received by the player at step 401 to initiate another instance of the wagering game. Alternatively, if a determination is made, at decision box 403, that a bonus-triggering event has occurred, a subsequent determination is made, at decision box 404, as to whether an initially eligible wager amount was previously received from the player at step 401. When the player has made an eligible wager (e.g., a Max Bet), a determination is made, at decision box 405, as to whether to award the bonus to the player. If a bonus award is to be provided, the bonus award is awarded to the player at step 408 and thereafter, the generated game outcome is evaluated and any further winning outcomes are awarded to the player at step 409*b*. Alternatively, if no bonus award is to be provided, the generated game outcome is evaluated and any winning outcomes are awarded to the player at step 409*a*. It should be noted that steps 409*a* and 409*b* have been subdivided for illustration purposes only, and that the evaluation and awarding of outcomes is the same in each of steps 409*a-b*. Returning now to decision box 404, if a determination is made that the player did not provide an initially eligible wager amount, a subsequent determination is made, at decision box 407, as to whether the player is a qualified player that is eligible for the bonus award even though an initially eligible wager amount was not received. When the player has made a non-eligible wager (i.e., a wager that does not initially qualify the player for the bonus award, such as a wager less than the Max Bet), the bonus-triggering event can still initiate the bonus feature or award if the player has achieved certain rule-adjusting activities, which may be stored and evaluated from database 406. In the exemplary method, rule-adjusting activities are related to the randomly generated game outcomes occurring in the wagering game prior to the bonus-triggering event and this particular wagering game instance.

Some examples of rule-adjusting activities may include achieving a 5-of-a-Kind spin, achieving three consecutive winning outcomes on a payline over three consecutive spins, completing one or more other game-related activities in prior instances, etc. Rule-adjusting activities may be related to game outcomes occurring in the basic game and also to outcomes occurring in bonus features. For example, a rule-adjusting activity may be winning at least three free spins during a designated bonus feature, or, in an interactive picking game, achieving a particular credit level or exceeding a predetermined number of consecutive successful picks.

Some embodiments may include different thresholds, for both wagers and for rule-adjusting activity, that qualify a player for bonus awards. In one embodiment, the lower the player's initial bet level, the higher the threshold of the rule-adjusting activity. In such a tiered-threshold structure, a first wager may require the player to obtain a first level of achieved rule-making activities to qualify their non-eligible wager. A second, lower wager by second player may require the player to obtain a second level of achieved rule-making activities to qualify their ineligible wager. In the tiered-threshold structure, the first threshold will be a lower threshold than the second threshold as the first wager is greater than the second wager. Similarly, the probabilities of winning the bonus, and the value of the bonus, may reflect the different thresholds for wagers and rule-adjusting activities.

When a bonus feature is triggered by a player who has made a non-eligible wager, any rule-adjusting activities that the player has achieved are evaluated in accordance with a predetermined qualification scheme, to determine if the player's achieved activities might enable the player to be eligible for the bonus feature or award. Thus, even though the player did not make an initially eligible wager amount, the player may qualify for the bonus feature or award based on their prior gaming activity. When the player's achieved activities meet the requirements set out in the qualification scheme, the player can qualify for enhanced eligibility that allows the player to play the bonus feature for the bonus award.

Returning now to decision box 407, if the player is determined to not be a qualified player, the generated game outcome is evaluated and any winning outcomes are awarded to the player at step 409*b*. Alternatively, if the player is determined to be a qualified player, a determination is made, at decision box 405, as to whether to award the bonus to the player. If a bonus award is to be provided, the bonus award is awarded to the player at step 408 and thereafter, the generated game outcome is evaluated and any further winning outcomes are awarded to the player at step 409*b*. Alternatively, if no bonus award is to be provided, the generated game outcome is evaluated and any winning outcomes are awarded to the player at step 409*a*.

It should be noted that rule-adjusting activities may persist throughout a gaming session and even, in some embodiments, across multiple gaming sessions. Achieved rule-adjusting activities may be stored for later assessment in the database 406 which may be located in the system memory, in a memory storage site in a player account related to a gaming website or a gaming community, on a remote game server, or on any other suitable storage media able to be accessed by the one or more processors.

Although, in the above embodiment, a determination is made, at decision box 405, as to whether a bonus has been won, in some embodiments, whenever a bonus-triggering event is determined to have occurred (403), and the determination is made that the player provided an initially eligible wager amount (404) or that the player is an otherwise qualified player (407), a bonus award, such as a progressive value, may be immediately awarded to the player. In other embodiments, the bonus-triggering event may award a secondary bonus game, in which the player may be awarded further game play that determines whether one or more bonus award will be provided to the player. In these embodiments, decision box 405 is unnecessary and the positive determinations from decision boxes 404 or 407 cause the bonus award/feature to be immediately provided to the player at step 408. Wagering games that include adjustable eligibility for bonus features can enhance a game-playing experience and generate interest and enthusiasm among players of the wagering game. By providing an opportunity to win a large award for a lesser bet, the wagering game can attract a wider audience of participants, who like to prolong their gaming sessions by making smaller wagers, and still desire the thrill and anticipation of playing for large awards.

In general, rule-adjusting activities in accordance with the claimed invention may be modified and adapted so that they can be applied to various wagering games. For example, a video-poker game may include rule-adjusting activities such as achieving a flush hand of diamonds on a spin, or achieving four two-pair hands of Jacks and 3's during a gaming session. Rule-adjusting activities may result in pay-offs independently of their rule-adjusting significance, such as the poker hands that are included in a conventional paytable, and may be non-traditional and even arbitrary activities.

Rule-adjusting activities and the qualification schemes used to evaluate the activities may be fixed by definitions that are resident in wagering game instructions—"hard-wired" into the game. Also, some embodiments of the wagering game may include rule-adjusting activities that can be defined and modified during the wagering game, for example, rule-adjusting activities that can be selected by the player during game play, and the qualification scheme may include options to take into account various possible player selections. Alternatively, a rule-adjusting activity may be defined by an outcome, random and otherwise, that occurs during game-play.

Game-play can be tailored to provide varying incentives for players to make eligible wagers, even when some non-eligible wagers can enable a player to play the bonus feature. For example, in the embodiment shown in FIG. 4, even though players making both initially eligible and non-eligible wagers can proceed to play the same bonus feature or achieve the same award, the probability of winning the bonus feature may be increased for the player making the initially eligible wager. Other methods of incentivizing a player to make an initially eligible wager are described in the following FIGS. 5 and 6. Still other variations and combinations thereof that practice the principles and inventive elements of the claimed invention will be evident to those skilled in the art and are considered to be within the scope of the claimed invention.

Figure 5:
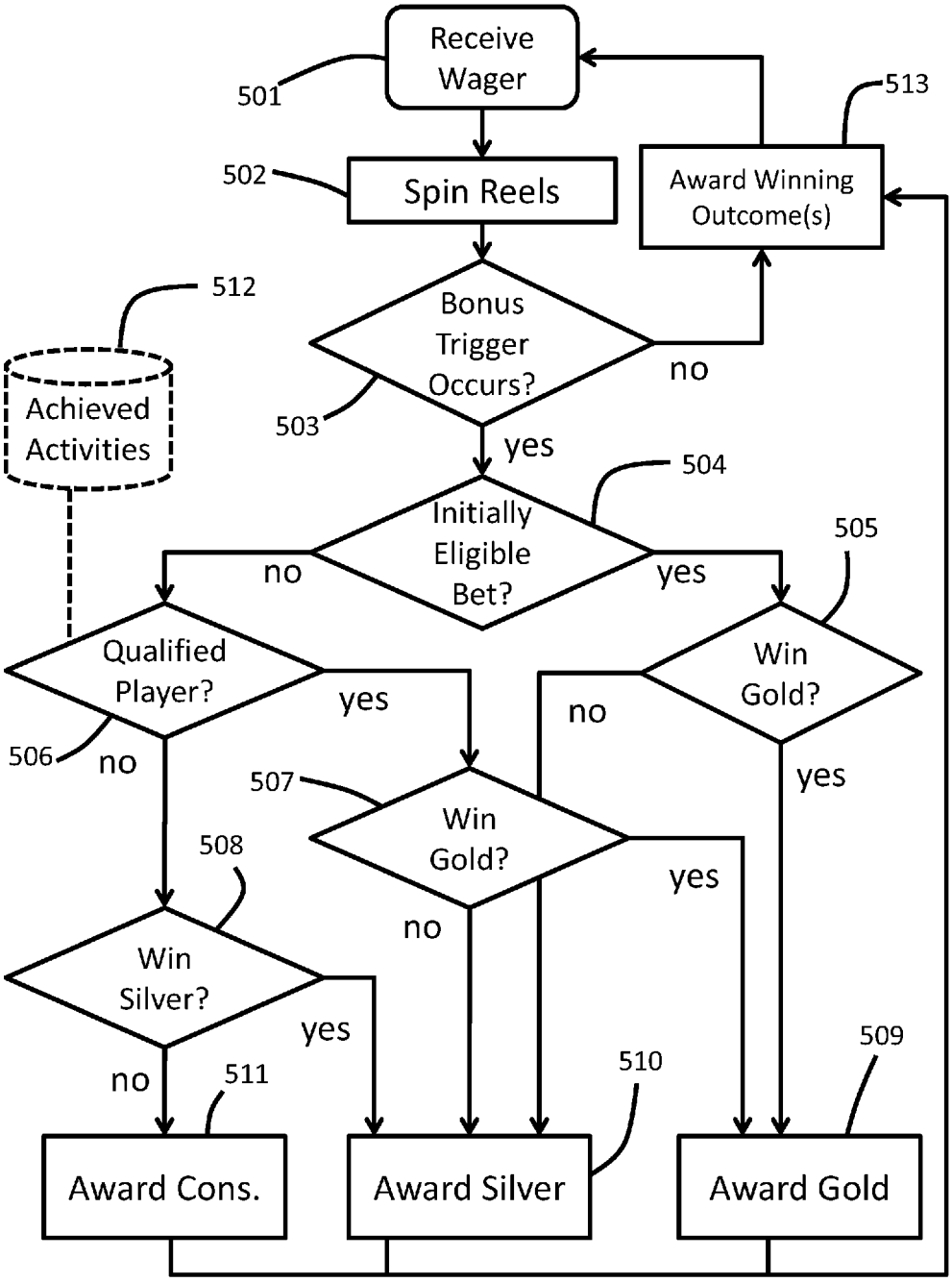
FIG. 5 is a schematic depiction of another embodiment of the claimed invention.

FIG. 5 shows another embodiment of a wagering game with adjustable eligibility for a bonus feature. In the embodiment, the game provides a bonus feature including three awards: Gold, Silver, and Consolation awards, in order of descending value. The embodiment receives a wager, either eligible or non-eligible, at step 501 and proceeds in the same fashion as the previous embodiment through steps 502-503 up to step 504. At step 504, when the randomly generated game outcome is a bonus-triggering event, and the player has made an initially eligible wager, the bonus feature is initiated and the player begins play of the bonus feature at step 505 to win either the Gold award or the Silver award. Like the previous embodiment, when the bonus feature is triggered by a player who has made an initially non-eligible wager, any rule-adjusting activities (i.e., those stored in the database 512) that the player has achieved are evaluated at step 506, to determine if the player's achieved activities qualify the player for enhanced eligibility. When the player's achieved activities meet the requirements set out in the qualification scheme, the player qualifies to play the bonus feature which begins at step 507, to win either the Gold award or the Silver award. Alternatively, when the player's achieved activities do not qualify the player for enhanced eligibility, the player plays the bonus feature which begins at step 508, to win either the Silver award or the Consolation award. As previously described, the probability of winning the Gold award may be increased for the player making the initially eligible wager, over the qualified player making the initially non-eligible wager, and other variations may be implemented to incentivize the player to make an initially eligible wager. It should also be noted that steps 505 and 507 do not necessarily denote different bonus games or features—they may indeed be the step of playing the same bonus feature but are shown separately to illustrate that different paths are taken to arrive there. After receiving an award in steps 509, 510, or 511, the generated game outcome is evaluated and any winning game outcomes are awarded to the player at step 513.

Figure 6:
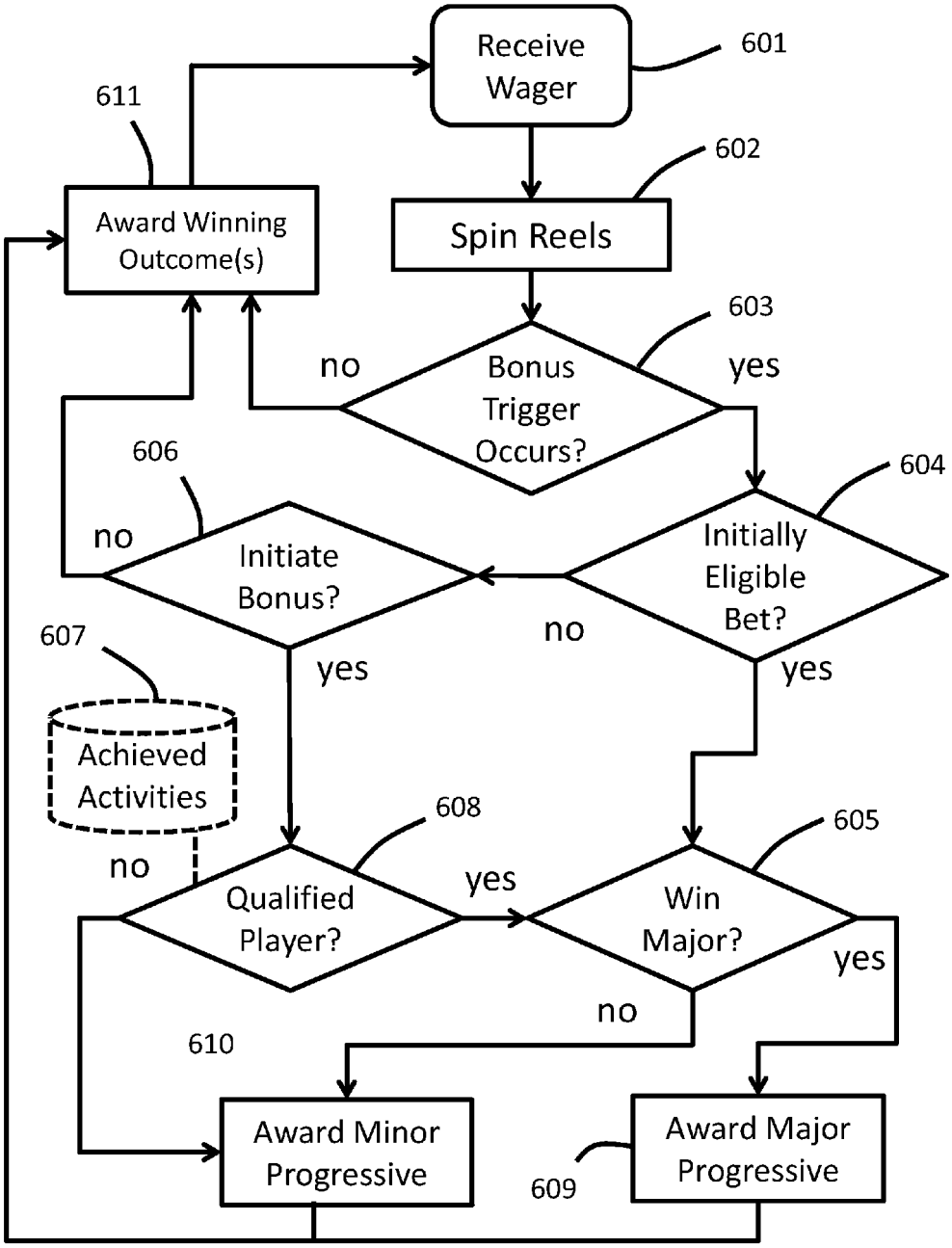
FIG. 6 is schematic depiction of still another embodiment of the claimed invention.

FIG. 6 shows yet another embodiment of a wagering game with adjustable eligibility for bonus features. In the embodiment, the bonus features are "progressive jackpot" awards and are presented as a Major Progressive award and a Minor Progressive award, in order of descending value. The embodiment receives a wager, either eligible or non-eligible, at step 601 and proceeds in a fashion similar to the previous embodiments through steps 602-603 up to step 604.

At step 604, when the randomly generated game outcome is a bonus-triggering event and the player has made an initially eligible wager, the player plays the bonus feature beginning at step 605, to win either the Major Progressive award or the Minor Progressive award. In this embodiment, when the bonus feature is triggered by a player who has made an initially non-eligible wager, an additional, randomly generated outcome at step 606 determines whether the bonus feature will be initiated or not. If the generated outcome does not initiate the bonus feature, the generated game outcome is evaluated and any winning outcomes are awarded to the player at step 611. If the bonus feature is initiated at step 606, a subsequent evaluation of the player's achieved rule-adjusting activities (e.g., those stored in the database 607) occurs at step 608, to determine if the player qualifies for enhanced eligibility. When the player's achieved activities meet the requirements set out in the qualification scheme, the player qualifies to play the bonus feature beginning at step 605, to win either the Major Progressive award or the Minor Progressive award. When the player's achieved activities do not qualify the player for enhanced eligibility, the player wins the Minor Progressive award. As in the previous embodiments, after receiving an award in steps 609 or 610, the generated game outcome is evaluated and any winning game outcomes are awarded to the player at step 611.

Figure 7:
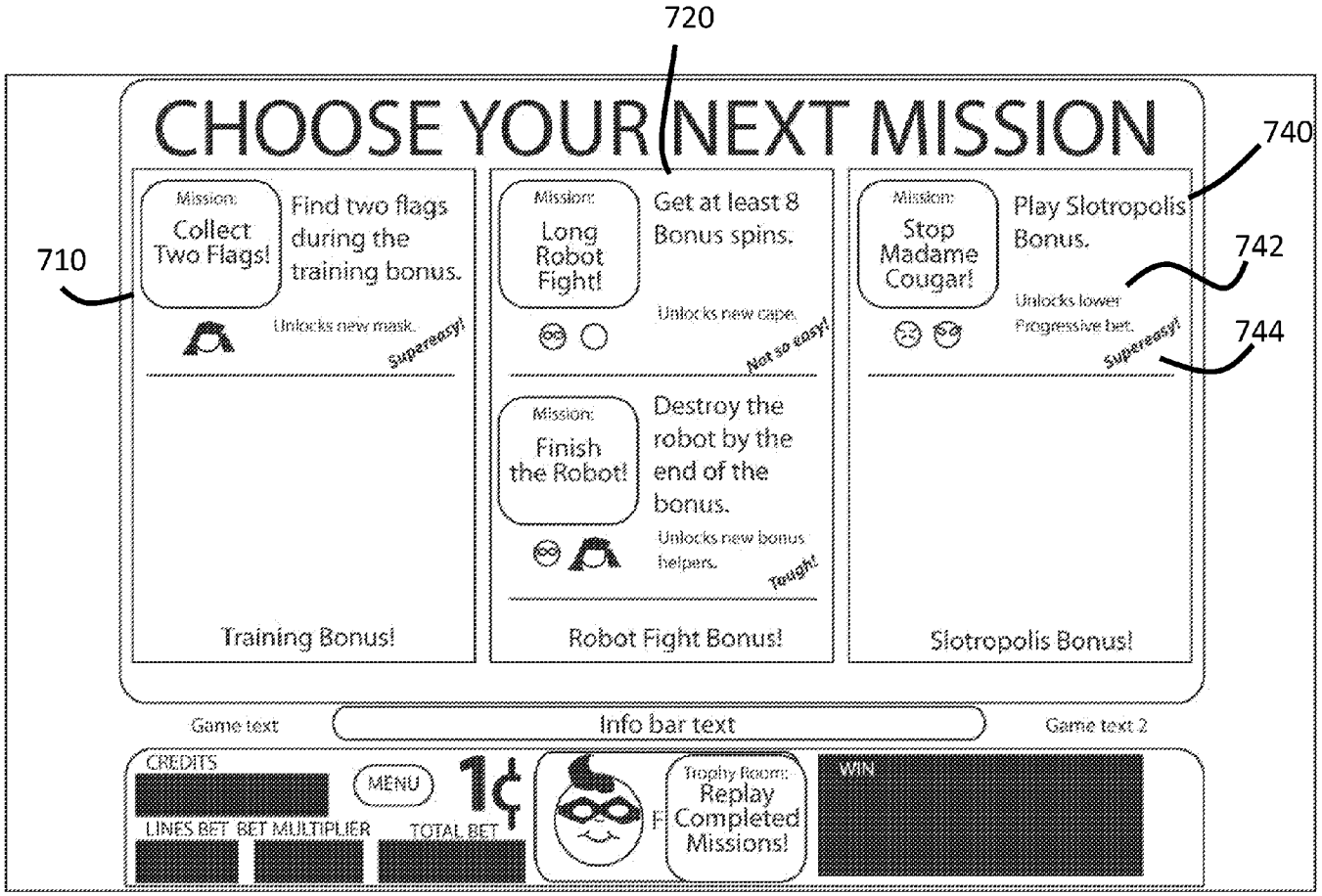
FIG. 7 is an image from an embodiment of the present invention, showing a selection screen of a plurality of secondary game sequences.
Figure 8:
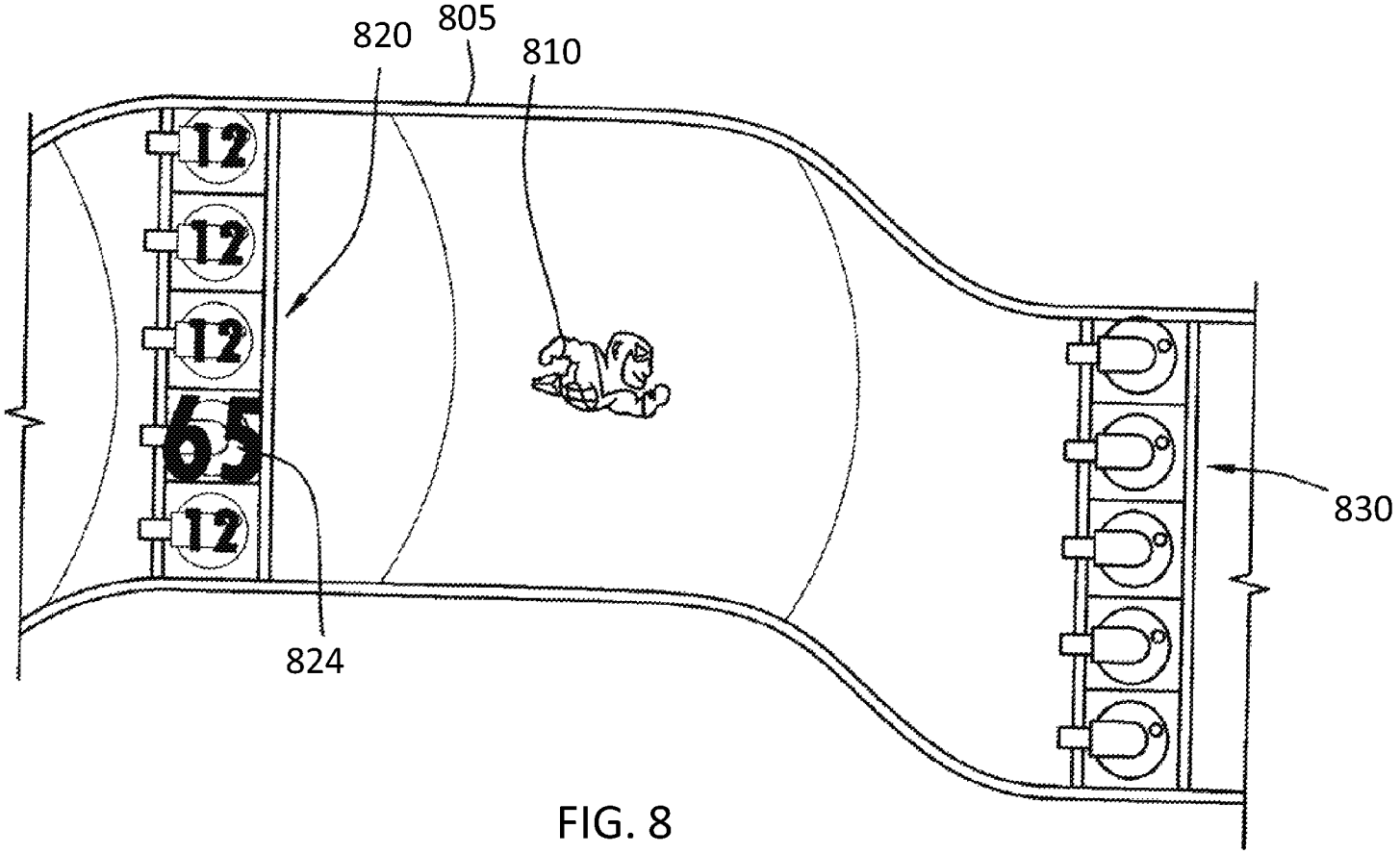
FIG. 8 is an image from the embodiment of FIG. 7, showing a player-directed secondary game sequence.

More examples of rule-adjusting activities can be found in the Super Team wagering game, depicted in FIGS. 7-8. Super Team includes a plurality of secondary game sequences (i.e., bonus games/features) that are woven into the basic game play scenarios. As shown in FIG. 7, players can select to participate in particular secondary game sequences, for example, the Training Bonus 710, the Robot Fight Bonus 720, and the Slotropolis Bonus 740, that can be triggered by bonus-triggering events during the basic game. Within the bonus features, a player has the option to select a mission to be achieved during the bonus feature. Additional information, such as, a predetermined award outcome 742 (e.g., unlocks lower progressive bet) for completing the mission and the difficultly level 744 (e.g., supereasy) of the game sequence can be displayed on the screen, as well. Some of the missions can be designated as rule-adjusting activities, so that achieving them during the bonus feature can facilitate the player being qualified for top awards while placing non-eligible wagers.

Some of the secondary-game sequences in the embodiment may be player-directed, where the player interacts with the game to affect the outcome. The Training Bonus shown in FIG. 8 illustrates an exemplary game sequence for a player-directed secondary game displayed on a gaming terminal. The game sequence illustrated in FIG. 8 is an interactive bonus game with the player having a set number of picks as a virtual character 810 moves through a training maze defined by the boundaries of a pipe 805. The game sequence is player-directed, which means the player chooses his picks by steering his virtual character 810 up or down. The virtual character 810 is navigating the maze based on direct input received from the player via a gaming system input interface. While navigating through the pipe 805, the virtual character 810 crosses different water cannon stations 820, 830, which define at least some of the picks. For example, as the virtual character 810 crossed the first water cannon station 820, he passed over the fourth water cannon from the top 824, which resulted in the player receiving a higher number of award points than if the player had picked any of the remaining four water cannons. The player will have at least one more opportunity in the illustrated embodiment to select another water cannon at the second water cannon station 830. By successfully completing the mission, for example, receiving more than a certain number of award points during the bonus, the player can achieve this designated rule-adjusting activity. Alternatively, directing the virtual character 810 through the entire pipe 805 without touching the sides of the pipe 805 may be designated as a rule-adjusting activity. Further, in some embodiments, the threshold to achieve a rule-adjusting activity may be to both achieve a certain minimum number of award points and keep the virtual character 810 from touching the sides of the pipe 805.

One of the benefits of the features associated with the player-direct secondary game sequences and the ability to select from a plurality of sequences is that it allows players flexibility in their gaming experience including having customized virtual character(s), choosing the desired game sequence, and choosing the level of difficulty for achieving a certain skill-based goal. This flexibility can increase the player's excitement and interest with a wagering game and/or a particular gaming session. Additionally, the player can choose which rule-adjusting activities to attempt, and so gain a feeling of controlling the game and concentrating on attainable goals.

A further exemplary player-directed secondary game sequence is the Slotropolis Zoo Bonus (not shown), which was also introduced above in the discussion of FIG. 7. In this player-directed secondary game sequence, a primary display area of a gaming system is set to allow free spins of a slots game. The symbols on the slot reels may be altered to include cat symbols and blank symbols. The game sequence begins on the top or secondary display area with the display of a villain (e.g., Madame Cougar) releasing big cats from their cages at the zoo. The player's virtual character must capture the released cats within a predetermined number of free spins. When a cat appears on a reel as a result of a free spin, the player's virtual character plays a skill-based game to catch the cat. It is also contemplated that additional virtual characters (e.g., Helper Heroes) may assist with catching the cats or improving the chances of the reels displaying a cat symbol, and thus, triggering the skill-based game. After catching a certain number of cats or after catching all the released cats under a certain threshold of attempts, the player may receive a predetermined award outcome for achieving the goal associated with the game sequence. By completing the player-selected goal, the player adds another rule-adjusting activity to those already stored in the database, and increases the probability of playing for a top award after making a non-eligible wager.

The claimed invention can be implemented in various forms, including a method; a gaming terminal for playing the wagering game with adjustable eligibility for bonus features; a gaming system including a controller with one or more processors, a display, and a wager input device, the controller being operable to conduct the wagering game. The claimed invention can also be embodied as computer-readable media comprising executable instructions for conducting the wagering game, and as other embodiments and combinations thereof, as described herein and as envisioned by a skilled artisan, while still practicing the principles and inventive elements of the invention.

Each of these embodiments and obvious variations thereof is contemplated as falling within the spirit and scope of the claimed invention, which is set forth in the following claims.

The invention claimed is:

1. A method of adjusting eligibility rules for wager-dependent bonus features in a wagering game, the wagering game including one or more rule-adjusting activities related to a randomly generated game outcome achieved during play of the wagering game, the method comprising:

receiving a wager from a player, via an input device, to initiate a randomly generated game outcome of a plurality of game outcomes for the wagering game, the randomly generated game outcome being displayed to the player on one or more displays;

determining, via one or more processors, whether the received wager is an initially eligible wager amount or an initially non-eligible wager amount;

evaluating, via the one or more processors, any of the one or more rule-adjusting activities achieved by the player during play of a previous instance of the wagering game to determine if one or more of the achieved rule-adjusting activities is sufficient to treat an initially non-eligible wager amount as a qualified wager;

in response to the bonus-triggering event occurring and the determination that the initially eligible wager amount was received, awarding the player a first bonus award;

in response to the bonus-triggering event occurring and the determination that the initially non-eligible wager amount was received, awarding the player a second bonus award if the received non-eligible wager amount can be treated as a qualified wager.

2. The method of claim 1, wherein the first bonus award and the second bonus award are the same award.

3. The method of claim 1, wherein the first bonus award has a higher expected value than the second bonus award.

4. The method of claim 1, wherein the one or more rule-adjusting activities include one or more of achieving a predetermined outcome during the prior game play, triggering a predetermined bonus feature during the prior game play, and achieving a predetermined outcome while playing a predetermined bonus feature during the prior game play.

5. The method of claim 1, further comprising, in response to the bonus-triggering event occurring, receiving the initially non-eligible wager amount, and the evaluation that the initially non-eligible wager amount cannot be treated as a qualified wager, awarding the player a third bonus award, the third bonus award being different from, and having a lower expected value than, both the first and second awards.

6. The method of claim 1, wherein the second bonus award comprises extended game play, and wherein the expected value of the second bonus award increases with the amount wagered.

7. The method of claim 6, wherein a maximum expected value of the second bonus award is the same as the expected value of the first bonus award.

8. The method of claim 1, wherein one or more of the rule-adjusting activities are selected by the player.

9. The method of claim 1, wherein the first and second bonus awards are bonus features awarding extended game play.

10. The method of claim 9, wherein the player making the initially eligible wager amount plays a first bonus feature with a first probability of winning a maximum-value award, the player making the initially non-eligible wager amount that can be treated as a qualified wager plays a second bonus feature with a second probability of winning the maximum-value award, and the player making the initially non-eligible wager amount that cannot be treated as a qualified wager cannot win the maximum-value award.

11. The method of claim 10, wherein the first probability is higher than the second probability.

12. A gaming system primarily used for conducting a wagering game including adjustable eligibility rules for wager-dependent bonus features, the system comprising:

an input device for receiving a wager from a player to initiate the wagering game, the wagering game including at least one bonus-triggering event;

one or more displays for displaying game information; and a controller being in communication with the wager input device and the one or more displays, the controller including one or more processors and being operable to:

detect a wager received via the input device, the wager including an initially eligible wager amount or including no more than an initially non-eligible wager amount, evaluate, via the one or more processors, any non-wager rule-adjusting activities related to a randomly generated game outcome achieved during play of the wagering game to determine if one or more of the achieved non-wager rule-adjusting activities qualify the player for enhanced eligibility according to a predetermined qualification scheme; and in response to a bonus-triggering event following the no more than an initially non-eligible wager amount, randomly generate an outcome to determine awarding the player a bonus award if the player is qualified for enhanced eligibility based on the one or more achieved non-wager rule-adjusting activities, and award the player the bonus award.

13. The gaming system of claim 12, wherein the probability of winning the bonus award or the value of the bonus award increases with the amount wagered.

14. The gaming system of claim 12, wherein the one or more rule-adjusting activities include one or more of achieving a predetermined outcome during the prior game play, triggering a predetermined bonus feature during the prior game play, and achieving a predetermined winning outcome while playing a predetermined bonus feature during the prior game play.

15. The gaming system of claim 12, wherein one or more of the rule-adjusting activities are selected by the player.

16. The gaming system of claim 12, wherein the wagering game comprises a basic game and a bonus game, and one or more of the rule-adjusting activities are achieved based on one or more randomly generated outcomes occurring during the basic game.

17. The gaming system of claim 12, wherein the wagering game comprises a basic game and a bonus game, and one or more of the rule-adjusting activities are achieved based on one or more randomly generated outcomes occurring during the bonus game.

18. The gaming system of claim 12, wherein the wager-dependent bonus features include a first bonus feature enabled by a bonus-triggering event following a first wager, and a second bonus feature enabled by a bonus-triggering event following a second wager, and wherein the first wager is larger than the second wager.

* * * * *